US009957071B2

(12) United States Patent
Gatteschi

(10) Patent No.: US 9,957,071 B2
(45) Date of Patent: May 1, 2018

(54) BUNDLE OF CONTAINERS, IN PARTICULAR BOTTLES, CANS OR THE LIKE, AND PROCESS FOR MAKING SUCH A BUNDLE

(71) Applicant: OCME S.R.L., Parma (IT)

(72) Inventor: Emanuele Gatteschi, Poppi (IT)

(73) Assignee: OCME S.r.l., Milan (IT)

( * ) Notice: Subject to any disclaimer, the term of this patent is extended or adjusted under 35 U.S.C. 154(b) by 0 days. days.

(21) Appl. No.: 15/022,519

(22) PCT Filed: Sep. 15, 2014

(86) PCT No.: PCT/IB2014/064518

§ 371 (c)(1),
(2) Date: Mar. 16, 2016

(87) PCT Pub. No.: WO2015/036977

PCT Pub. Date: Mar. 19, 2015

(65) Prior Publication Data

US 2016/0221735 A1 Aug. 4, 2016

(30) Foreign Application Priority Data

Sep. 16, 2013 (IT) ..... MI2013A1526

(51) Int. Cl.
*B65D 71/08* (2006.01)
*B65B 21/24* (2006.01)
(Continued)

(52) U.S. Cl.
CPC ..... *B65B 21/245* (2013.01); *B65B 53/02* (2013.01); *B65B 61/14* (2013.01); *B65D 71/08* (2013.01);
(Continued)

(58) Field of Classification Search
CPC ..... B65D 71/08; B65D 75/56; B65D 2571/00438
(Continued)

(56) References Cited

U.S. PATENT DOCUMENTS 3,013,655 A * 12/1961 Brody ..... B65D 75/56 134/167 R
3,031,359 A * 4/1962 Blank ..... B65D 63/1009 206/813
(Continued)

FOREIGN PATENT DOCUMENTS

FR 2602748 2/1988

OTHER PUBLICATIONS

PCT/IB2014/064518, European Patent Office, International Search Report of the International Searching Authority, dated Jan. 15, 2015.
(Continued)

*Primary Examiner* — Steven A. Reynolds
(74) *Attorney, Agent, or Firm* — Ice Miller LLP

(57) ABSTRACT

The present invention concerns a bundle (1) of containers (3), including a packaging film (2) wrapped around a set of containers (3). The film (2) defines a bottom portion (2*a*), at least one pair of side opposite portions (2*b*) extending from the bottom portion (2*a*) and a covering portion (2*c*) extending between the side portions (2*b*) from an opposite part with respect to the bottom portion (2*a*). The bundle (1) also comprises a handle (4) having a central portion (4*a*) arranged at the covering portion (2*c*) of the film (2) and a pair of opposite joining adhesive portions (4*b*), extending from the central portion (4*a*) each arranged at least at a respective side portion (2*b*) of the film (2). Each of the joining adhesive portions (4*b*) of the handle (4) has a respective end (4*c*) that engages the bottom portion (2*a*) of the film (2).

7 Claims, 2 Drawing Sheets

(51) Int. Cl.
*B65D 75/56* (2006.01)
*B65B 53/02* (2006.01)
*B65B 61/14* (2006.01)

(52) U.S. Cl.
CPC .... *B65D 75/56* (2013.01); *B65D 2571/00438* (2013.01)

(58) Field of Classification Search
USPC ..... 206/497, 428, 432, 427
See application file for complete search history.

(56) References Cited

U.S. PATENT DOCUMENTS 4,779,731 A * 10/1988 Fujio ..... B65D 71/08 206/432
4,830,895 A 5/1989 Bernard
5,048,687 A * 9/1991 Suzuki ..... B65D 71/10 206/494
5,570,787 A * 11/1996 Danovaro ..... B65D 71/50 206/142
5,630,307 A * 5/1997 Cathala ..... B29C 47/0021 53/398
2013/0001124 A1 * 1/2013 Booch ..... B65D 85/16 206/497
2013/0248397 A1 * 9/2013 Hartwig ..... B65D 21/0204 206/427

OTHER PUBLICATIONS

PCT/IB2014/064518, European Patent Office, Written Opinion of the International Searching Authority, dated Jan. 15, 2015.

* cited by examiner

BUNDLE OF CONTAINERS, IN PARTICULAR BOTTLES, CANS OR THE LIKE, AND PROCESS FOR MAKING SUCH A BUNDLE

CROSS-REFERENCE TO RELATED APPLICATIONS

The present application is a U.S. national stage of, and claims the priority benefit of, International Patent Application Serial No. PCT/IB2014/064518, filed Sep. 15, 2014 and Italian Patent Application Serial No. MI2013A001526, filed Sep. 16, 2013, the text and drawings of which are hereby incorporated by reference in their entireties.

The present invention refers to a bundle of containers, in particular bottles, cans or the like.

Another object of the present invention is a process for making bundles of containers, in particular bottles, cans or the like.

As it is known, the packaging of containers, like for example bottles, cans or the like, for food products, in particular of the liquid type, is carried out with processes that firstly provide the gathering of predetermined sets of containers, and then the wrapping of the latter by means of respective packaging films that are, generally, made of a heat-shrinkable plastic material.

Normally, the bundles obtained are provided with corresponding gripping handles which allow them to be handled and/or manually transported more easily.

The gripping handles can be applied to the respective packaging films both subsequently with respect to the forming of the respective bundles, and previously with respect to it.

In order to optimise and speed up the processes of forming the aforementioned bundles, it is common practice to feed the packaging films on which the respective gripping handles in the form of a continuous tape are applied and to proceed with the application of the gripping handles before wrapping the packaging films around the containers to be packed. Once the gripping handles have been applied, the continuous tape is suitably cut into sections, each corresponding to a packaging film provided with a corresponding gripping handle.

Subsequently, every packaging film is wrapped around a respective set of containers to be packed and suitably heated so as to be shrinked around such containers.

The gripping handles normally applied to the packaging films have a tape-shaped structure on which it is possible to identify a central gripping portion and a pair of joining adhesive portions extending from the central gripping portion. The gripping portion of each gripping handle lies at the upper part of the corresponding bundle made, whereas the joining adhesive portions remain glued to the sides of the latter.

In order to further cut down the costs for forming the aforementioned bundles, the thickness of the films is usually reduced and, consequently, also the overall mass of the packaging films is reduced.

Although the reduction of the overall grammage of the packaging films has considerable advantages in terms of cutting down production and commercialisation costs of the obtained bundles, as well as in terms of a reduction in the materials to be disposed of, it leads to considerable problems in terms of structural resistance to stresses, of continuity in the forming process, as well as of producing excessive waste at the end of the production process.

In particular, the Applicant has found that the reduction of the thickness of the packaging films used for forming the aforementioned bundles considerably weakens the structure thereof at the junction areas between the latter and the corresponding gripping handles. In particular, when the bundles are lifted, transported or handled by acting directly on the respective gripping handles, static and dynamic stresses are generated at the junction areas of the gripping handles. Such stresses, in some cases, cause the respective packaging films to become permanently deformed, in other cases they cause the films to break or tear, with negative consequences.

The structural weakening of the packaging films also leads to a series of drawbacks that can be detected during the step of applying the gripping handles. In particular, since the packaging films normally move forward at high advancing velocities, the application of the respective gripping handles tends to permanently deform or, even, break and tear the packaging films being supplied. These negative effects are due to the braking action that the gripping handles in application exert on the advancing packaging films. The undesired deformation, breaking or tearing of the packaging films, negatively affects both the continuity of the processes for forming the bundles, and the overall number of bundles to be disposed of at the end of the process.

In particular, the continuity of the processes is compromised due to the necessity of frequently interrupting the latter so as to remove the deformed, torn or broken films.

Moreover, the number of bundles that are not structurally suitable for being commercialised is particularly high.

The general purpose of the present invention is to propose a bundle of containers, in particular bottles, cans or the like, and a process for making the bundle, that is capable of solving the drawbacks found in the prior art.

One purpose of the present invention is to make bundles with packaging films having low thickness that are structurally resistant to stresses that are generated during their handling, lifting and/or transportation.

Another purpose of the present invention is to ensure that the packaging films having small thickness and the gripping handles applied to them are joined together.

Another scope of the present invention is to avoid the deformation, the tearing and/or the breaking of the packaging films with a low thickness during the step of applying the respective gripping handles.

A further purpose of the present invention is to ensure the continuity over time of the process of forming the bundles with films with a thin thickness.

Yet another purpose of the present invention is to reduce the overall number of the waste items at the end of the process.

The purposes specified above, and others, are substantially achieved with a bundle of containers, in particular bottles cans or the like, and with a process for making it, as expressed and described in the following claims.

It will be described, as an example, a preferred, but not exclusive, embodiment, of a bundle of containers, in particular bottles, cans or the like and a process for making it, in accordance with the present invention.

The description shall be carried out hereafter with reference to the attached drawings, provided only as an indication and therefore not for limiting purposes, in which.

Figure 1:
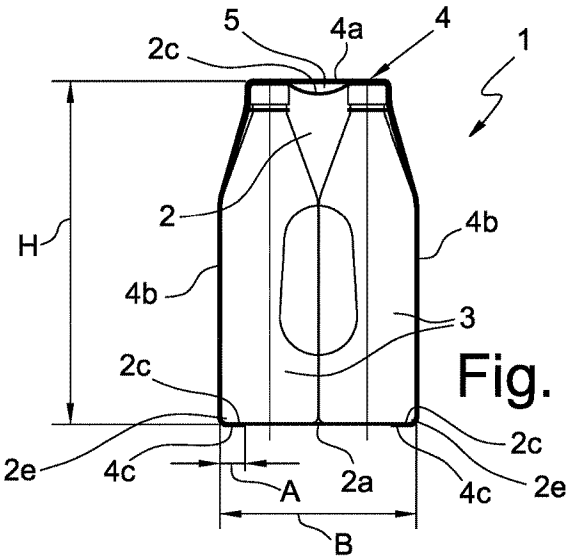
FIG. 1 is a front view of a bundle of containers, in particular bottles, cans and/or the like, in accordance with the present invention.
Figure 2:
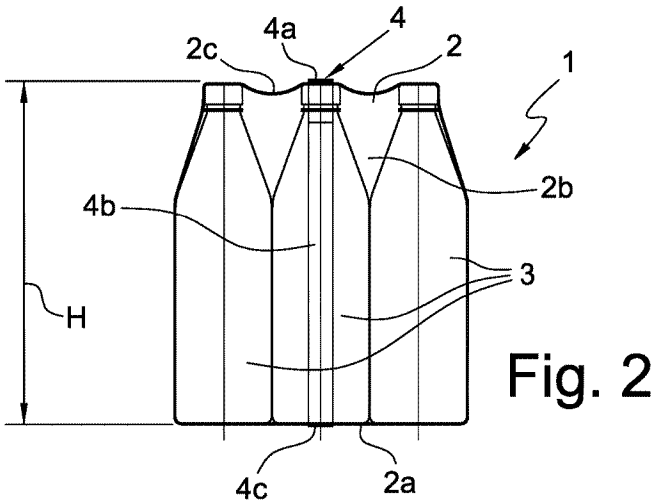
FIG. 2 is a side view of the bundle according to FIG. 1.
Figure 3:
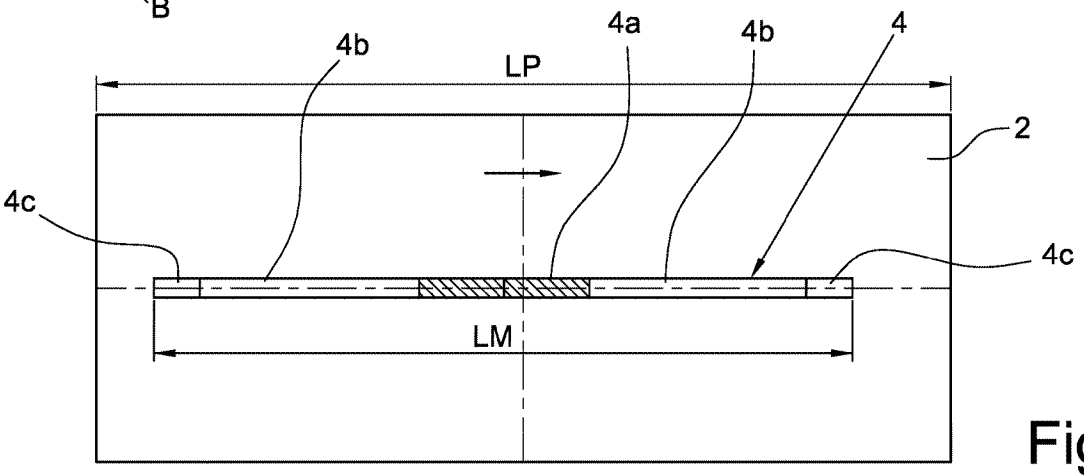
FIG. 3 is a schematic view from above of a respective packaging film provided with a respective gripping handle for making the bundle according to FIGS. 1 and 2.

With reference to FIGS. 1 and 2, reference numeral 1 wholly indicates a bundle of containers, in particular bottles, cans or the like, in accordance with the present invention.

As visible in FIGS. 1 and 2, the bundle 1 comprises at least one packaging film 2 wrapped around a predetermined set of containers 3. Subsequently to the winding of the packaging film 2 around the respective set of containers 3, the packaging film 2 defines a bottom portion 2*a*, obtained for example by overlapping the respective lead and tail edges of the packaging film itself, for resting the containers 3, at least one pair of opposite side portions 2*b* extending from the bottom portion 2*a* for laterally engaging the containers 3 and the covering portion 2*c* that extends between the side portions 2*b* from an opposite part with respect to the bottom portion 2*a*.

Again with reference to FIGS. 1 and 2, the bundle 1 also comprises a gripping handle 4, preferably having a substantially tape-shaped design, having a central gripping portion 4*a* that is arranged at the covering portion 2*c* of the packaging film 2 and a pair of opposite joining adhesive portions 4*b*, extending from the central gripping portion 4*a*, each arranged at least at a respective side portion 2*b* of the packaging film 2.

Advantageously, each one of the junction adhesive portions 4*b* of the gripping handle 4 engages with the respective side portion 2*b* of the packaging film 2 from the covering portion 2*c* to the bottom portion 2*a*.

According to a further advantageous aspect of the present invention, each joining adhesive portion 4*b* of the gripping handle 4 has a respective end 4*c* that engages the bottom portion 4*a* of the packaging film 2. The ends 4*c* of the joining adhesive portions 4*b* of the gripping handle 4 connect to the bottom portion 2*a* of the packaging film 2 giving the structure formed by the latter and by the gripping handle high resistance to the stresses that are generated during the handling, lifting and/or the transportation of the bundle 1.

Going further into detail, the central gripping portion 4*a* of the gripping handle 4 develops substantially according to the width of the covering portion 2*c* of the packaging film 2 and comprises at least one cardboard strip, that does not adhere to the film of packaging 2. The gripping portion 4*a* of the gripping handle 4 defines with the covering portion 2*c* of the packaging film 2 a gripping space 5 (FIG. 1) for inserting at least a hand's fingers.

Each joining adhesive portion 4*b* preferably develops according to a size that is greater than the height H of the bundle itself, which can be measured from the bottom portion 2*a* to the covering portion 2*c* of the packaging film 2, so that the respective end 4*c* engages both the bottom portion 2*a*, and the corresponding corner 2*e*.

Advantageously, the end 4*c* of each of the joining adhesive portions 4*b* of the gripping handle 4 engages a portion A of the bottom portion 2*a* of the packaging film 2 that has a length that is not smaller than 20 mm, preferably not greater than the diameter of a respective container 3 of the bundle 1, even more preferably ranging from 20 mm and the half of the width B of the bundle 1, optionally substantially equal to 25 mm.

Advantageously, the packaging film 2 is made of a heat-shrinkable material that has a thickness that is not greater than 40 μm, preferably comprised between 25 μm and 40 μm.

The formation of the aforementioned bundle 1 is carried out by means of the actuation of a process that comprises a step for supplying a plurality of gripping handles 4 in the form of a continuous tape that is suitably cut into sections and a step for feeding a plurality of packaging films 2 in the form of a continuous tape, also subsequently cut into sections.

Each gripping handle 4 is applied onto a respective packaging film 2, being supplied, which is subsequently wrapped around a respective predetermined set of containers 3.

Advantageously, on each packaging film 2 a gripping handle 4 is applied having an overall length LM that is not smaller than 7/10 of the overall length LP of the respective packaging film 2.

In accordance with the solution illustrated in figures from 1 to 3, on each packaging film 2 a gripping handle 4 having an overall length LM that is not shorter than 9/10 of the overall length LP of the respective packaging film 2 is preferably applied so that the winding step of each packaging film 2 around a respective set of containers 3 determines the positioning of the central gripping portion 4*a* of the respective gripping handle 4 at the covering portion 2*c* of the respective packaging film 2 and the positioning of each joining adhesive portion 4*b* of the respective gripping handle 4 at a respective side portion 2*b* of the corresponding packaging film 2, from the covering portion 2*c* to the bottom portion 2*a*.

In accordance with a further advantageous aspect of the present invention, on each film of packaging 2 a respective gripping handle 4 is applied the overall length LM of which is sufficient so that an end 4*c* of each of the joining adhesive portions 4*b* of the gripping handle itself be arranged at the bottom portion 2*a* of the respective packaging film 2 wrapped around the containers 3.

Advantageously, the step of applying the gripping handles 4 to the respective packaging films 2 is carried out by swinging the advancement velocity of the continuous tape of the packaging films 2 between a minimum advancement velocity and a maximum advancement velocity.

Such minimum and maximum velocities can be determined as a function of the lengths (LM, LP) respectively of the gripping handles 4 and of the packaging films 2.

The minimum and maximum velocities can also be determined as a function of the periods of time for the advancement and/or the acceleration and/or the deceleration of the continuous tape.

The minimum and maximum velocities can moreover be determined as a function of the average advancing velocity (VM) of the continuous tape of the packaging films that is established.

Of course, the aforementioned minimum and maximum velocities can be determined both as a function of one of the parameters mentioned above and as a function of the combination of two or more of such parameters.

Figure 4:
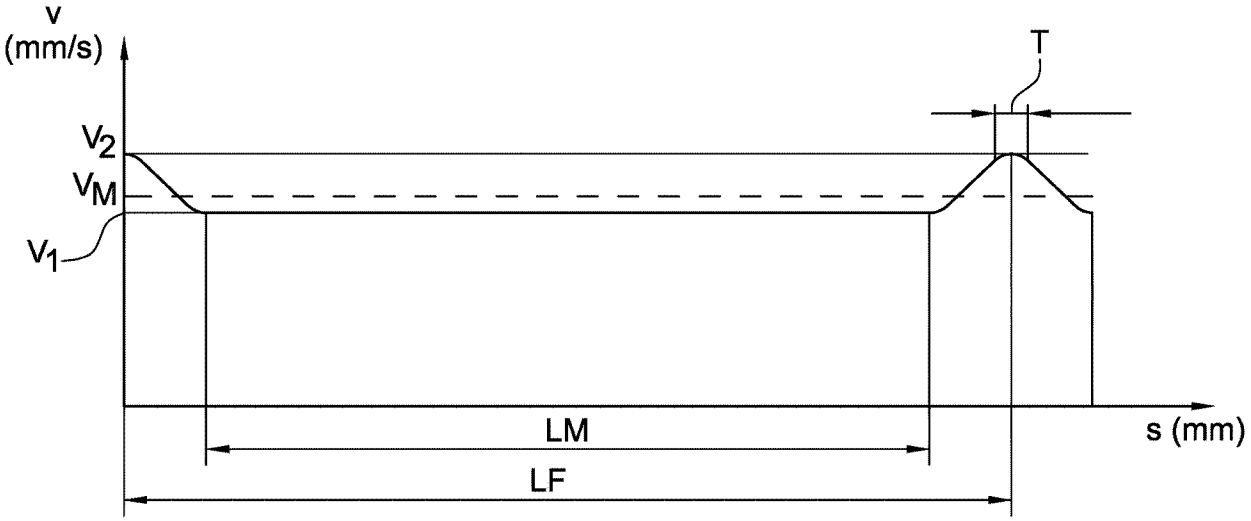
FIG. 4 is a representation of a first graph relative to the velocity variations of a continuous tape of packaging films during a first kind of application of the respective gripping handles.

As represented in the graph according to FIG. 4, the step of applying each gripping handle 4 to a respective film 2 being supplied is carried out by making the continuous tape of the packaging films 2 to advance at a first advancement velocity V1 which is maintained so as to ensure the entire overlapping of the gripping handle 4 to the respective packaging film 2. Once the gripping handle 4 is applied, the continuous tape is accelerated until reaching a second advancement velocity V2, higher than the first advancement velocity V1, which is maintained for a predetermined time period T, corresponding to a tail section of the film packaging 2 provided with the gripping handle 4 that is applied to an initial section of the subsequent packaging film 2, lacking the gripping handle 4.

Subsequently, the continuous tape is decelerated until reaching a first advancement velocity V1 before the adhesion of the corresponding gripping handle 4.

Figure 5:
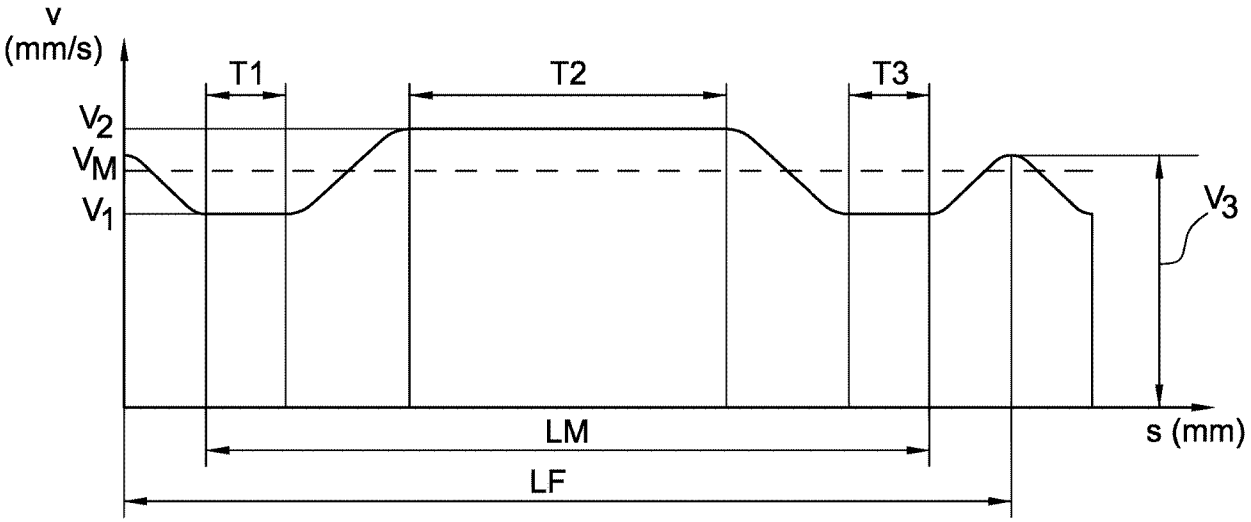
FIG. 5 is a representation of a second graph relative to the velocity variations of a continuous tape of packaging films during a second kind of application of the respective gripping handles.

As an alternative, as represented in the graph according to FIG. 5, the step of applying each gripping handle 4 to a respective packaging film 2 being supplied is advantageously carried out by making the continuous tape of the packaging films 2 advance at a first advancement velocity V1 which is maintained for a first time period T1 that is sufficient for applying the end 4*c* of the first joining adhesive portion 4*b* of the gripping handle 4 being applied.

Subsequently, the continuous tape is accelerated until reaching a second advancement velocity V2, higher than the first advancement velocity V1. The second advancement velocity V2 is maintained for a second predetermined time period T2, that is sufficient for approaching the end 4*c* of a second joining adhesive portion 4*b* of the gripping handle 4 being applied. The continuous tape is then decelerated from the second advancement velocity V2 to the first advancement velocity V1 near the end 4*c* of the second joining adhesive portion 4*b* of the gripping handle 4 being applied. Such a velocity is maintained for a third time period T3 that is sufficient for applying the end 4*c* of the second joining adhesive portion 4*b* of the gripping handle 4 being applied.

Subsequently, the continuous tape is again accelerated until reaching a third advancement velocity V3, which is faster than the first advancement velocity V1, corresponding to a tail section of the free packaging film 2, from the gripping handle applied, after which it is decelerated until reaching a first advancement velocity V1 corresponding to a lead section of the next packaging film 2, lacking the gripping handle 4.

Advantageously, the third advancement velocity V3 can be lower than or equal to the second advancement velocity V2.

The bundle described above and the process for making it overcomes the drawbacks found in the prior art and achieve important advantages.

Firstly, the application of gripping handles having joining adhesive portions that extend along the entire height of the respective bundles achieved with packaging films with low thickness and grammage gives such bundles high resistance to the stresses that are generated during the management, the lifting and the transportation thereof.

Consequently, the bundles are no longer subject to being permanently deformed, structurally torn or broken at the joining areas between the packaging films and the gripping handles so that the joining between the latter and the respective packaging films is ensured.

In addition, the oscillations of the advancement velocity of the continuous tape of the films of packaging during the various operation steps for the application of the gripping handles ensure the structural integrity of the packaging films before forming the bundles. In other words, the films of packaging are no longer subject to be tugged and torn due to the application of the gripping handles at the ends of the corresponding joining adhesive portions so that the packaging films engagingly receive the corresponding gripping handles without undergoing structural alterations. This makes it possible, on one hand to ensure the continuity of the process for forming the bundle since it is no longer necessary to interrupt the process for removing the films that are structurally compromised, on the other hand a considerable cutting down of the overall amount of waste at the end of the process.

What is claimed is:

1. A bundle (1) of containers (3), comprising:

at least one packaging film (2) wrapped around a predetermined set of containers (3), said packaging film (2) defining a bottom portion (2*a*) for resting said containers (3), at least one pair of facing side opposite portions (2*b*) extending from said bottom portion (2*a*) for laterally engaging said containers (3) and a covering portion (2*c*) extending between said side portions (2*b*) from an opposite part with respect to said bottom portion (2*a*);

a gripping handle (4) having a central gripping portion (4*a*) arranged at said covering portion (2*c*) of said packaging film (2) and a pair of opposite joining adhesive portions (4*b*), extending from said central gripping portion (4*a*) and each arranged at least at a respective side portion (2*b*) of said packaging film (2);

each of said joining adhesive portions (4*b*) of said gripping handle (4) engages the entire respective side portion (2*b*) of said packaging film (2) from said covering portion (2*c*) to said bottom portion (2*a*), wherein each joining adhesive portion (4*b*) of said gripping handle (4) has a respective end (4*c*) engaging said bottom portion (2*a*) of said packaging film (2), and wherein each said respective end is spaced apart from each other said respective end.

2. The bundle (1) according to claim 1, wherein:

said central gripping portion (4*a*) of said gripping handle (4) develops substantially according to the width of said covering portion (2*c*) of said packaging film (2), said central gripping portion (4*a*) of said gripping handle (4) delimiting with said covering portion (2*c*) of said packaging film (2) a gripping space (5) for inserting at least a hand's fingers;

each joining adhesive portion (4*b*) of said gripping handle (4) develops according to an amount higher than the height (H) of said bundle (1), which can be measured from the bottom portion (2*a*) to the covering portion (2*c*) of said packaging film (2), whereby the respective end (4*c*) engages both the bottom portion (2*a*) and the corresponding corner (2*e*) defined between this latter and the respective side portion (2*b*) of said packaging film (2).

3. The bundle (1) according to claim 1, wherein the end (4*c*) of each of said joining adhesive portions (4*b*) of said gripping handle (4) engages a section (A) of the bottom portion (2*a*) of said packaging film (2) having a length not smaller than 20 mm and not greater than the diameter of a respective container (3) of said bundle (1).

4. The bundle (1) according to claim 1, wherein said packaging film (2) is made of a heat-shrinkable material having a thickness not greater than 40 μm.

5. The bundle (1) according to claim 2, wherein the end (4*c*) of each of said joining adhesive portions (4*b*) of said gripping handle (4) engages a section (A) of the bottom portion (2*a*) of said packaging film (2) having a length not smaller than 20 mm.

6. The bundle (1) according to claim 2, wherein said packaging film (2) is made of a heat-shrinkable material having a thickness not greater than 40 μm.

7. The bundle (1) according to claim 2, wherein said packaging film (2) is made of a heat-shrinkable material having a thickness not greater than 40 μm and not less than 25 μm.

* * * * *